US005221243A

United States Patent [19]

Walker

[11] Patent Number: 5,221,243

[45] Date of Patent: Jun. 22, 1993

[54] PARA-PERIPHERAL SPORTS TRAINING CENTER

[76] Inventor: James J. Walker, 6051 Jacaranda #E, Carpenteria, Calif. 93013

[21] Appl. No.: 902,932

[22] Filed: Jun. 23, 1991

[51] Int. Cl.[5] ..... A63B 69/34

[52] U.S. Cl. ..... 482/83

[58] Field of Search ..... 482/83, 84–90, 482/146; 273/1 E, 1, 58, 1 GC, 55 R; 434/247

[56] References Cited

U.S. PATENT DOCUMENTS

| | | | |
|---|---|---|---|
| 3,503,608 | 3/1970 | Ylinen | 273/1 |
| 3,580,575 | 5/1971 | Speeth | 273/58 |
| 3,804,406 | 4/1974 | Viscione | 482/83 |
| 3,933,354 | 1/1976 | Goldfarb | 273/1 E |
| 4,169,592 | 10/1979 | Hall | 273/1 E |
| 4,627,620 | 12/1986 | Yang | 273/1 GC |
| 4,818,234 | 4/1989 | Redington | 434/247 |
| 4,940,228 | 7/1990 | Horvath | 272/76 |
| 4,955,602 | 9/1990 | Rastelli | 272/76 |
| 4,974,833 | 12/1990 | Hartman | 272/76 |

FOREIGN PATENT DOCUMENTS

| | | | |
|---|---|---|---|
| 2725662 | 12/1978 | Fed. Rep. of Germany | 482/83 |

OTHER PUBLICATIONS

Exhibits A,B,C,D,E.

*Primary Examiner*—Stephen R. Crow

*Attorney, Agent, or Firm*—W. Douglas English

[57] ABSTRACT

In the field of electronically controlled and monitored sports training, competition and amusement centers, particularly adapted for use with the oriental martial arts, but also suitable for rehabilitation training and progress measurement in connection with physical therapy applications, a multi-sided para-peripheral center in which a contestant may stand and move about, constructed as an octagonal cylinder, each of whose eight sides is a panel containing four elastically inflatable balls, suspended by elastic cords, each capable of absorbing a full impact strike without injury to the deliverer, and arrayed vertically at the typical height of head, chest, pelvis and knee of a simulated opponent, together with programmable timing and selection circuits which randomly activate a quartet of light-emitting diodes circumscribed about each of the thirty-two target balls, whose illumination designates the currently selected target, and sensor means for recording strikes if the designated target receives a blow before the designating lights are deactivated, plus an automatic cumulative proficiency scoring system for displaying to the trainee an objective record of his reaction times and overall attained physical agility at the completion of each exercise session.

19 Claims, 5 Drawing Sheets

PARA-PERIPHERAL SPORTS TRAINING CENTER

BACKGROUND

Field of the Invention

This invention relates to the field of electronically controlled and monitored sports training, competition and amusement centers, particularly adapted for use with the oriental martial arts, but also suitable for rehabilitation training and progress measurement in connection with physical therapy applications.

At least four sports-related application categories are possible: (a) a Karate or Martial Arts training facility; (b) a general coordination and reflex exercise tool; (c) a competition arena; and (d) a game of skill such as would be found in a Video Arcade facility.

With some additions the tool can be used in the area of medical rehabilitation. There is an increasing demand for objective testing of brain-injured persons prior to return to the workplace. At least three categories of medical rehabilitation applications are possible: (a) utilization by the brain injured for simple to complex response testing; (b) gross motor coordination techniques such as are employed in physical therapy and occupational therapy; (c) work-place evaluation to assess response and coordination.

A key concept in the present context is that of "para-peripheral" with respect to the trainee's field of vision. By para-peripheral we shall mean, herein, beyond the normal periphery of human sight, which is approximately 180° [i.e. about $\pi$ radians]. Thus a trainee or contestant cannot see all visual stimuli unless he continually turns his direction of sight away from any fixed, forward direction. Accordingly a para-peripheral surface in the present context shall mean a substantially vertical-axially-symmetric cylindrical surface or at least a quasi-cylindrical portion of such a surface whose horizontal cross-sectional boundary curve is more than semi-circular, which will be referred to as a para-peripheral arc. Likewise a para-peripheral volume shall denote a volume whose horizontal cross-section is a convex area circumscribed by a circle (or polygon inscribed therein) or at least by the union of a para-peripheral arc of a circle (or polygon inscribed therein) and a straight line joining the ends of the para-peripheral arc.

DESCRIPTION OF PRIOR ART

Non-Patent References

The martial arts of China, Japan and Korea originated when certain classes of people, either by caste or religious belief, were not allowed to own weapons. Training devices were developed to harden various parts of the body (mainly the hands and feet) and to cultivate the various forms of empty hand techniques for the use as weapons for striking and blocking. Striking surfaces were developed long ago and have remained in a crude state until recently. Some known types may be listed as follows:

1) One of the earliest types was the tree stump, cut to human height, or a post buried in the ground. The striking areas were wound with rope or other material.

2) A Makawari Board is a 2 × 4 board mounted in a holding fixture off the floor or buried in the ground. The striking areas are covered with foam.

3) Punching Bags of various sizes and shapes are used. These were hung from above, placed on the floor, or suspended between the floor and ceiling. Additional limbs may be added to give a more realistic effect.

4) Hand held striking surfaces, such as the single-hand Mit or the both-hand Shield allow the target to be moved from place to place by a training partner.

5) A recent innovation is the Wing Chun Wooden Dummy.

6) Instrumented striking surfaces include sensors for measuring force or impulse and reaction time.

7) A computer-controlled array of multiple striking surfaces, advertised as available commercially from Everfast Equipment Inc. of Spokane Wash., provides a system which regulates the speed and direction of up to 46 different hanging targets (altogether weighing up to 17 tons) which keep the trainee "moving, ducking, punching and popping" while proficiency is recorded by a camera system which provides subsequent subjective monitoring and evaluation of the trainee's performance.

Patent References

Ylinen shows an electrical reaction-measuring apparatus by which two competitors can compare their reaction times.

Speeth shows an impact toy including selectively impact operable electrical lights and associated circuitry.

Goldfarb et al shows a reflex-testing amusement device which simulates some of the competitive features of oriental martial arts. A pseudo-random sequence of lights designate 10 targets on two flat human figures and competing participants try to hit their own lights to turn off the designating light first. A single- player version is presented.

Mack shows a training and reaction time measuring apparatus for karate which includes resilient striking surfaces connected to electronic signaling and time-measuring devices with continuous programming facilities. The contestant faces an arcuate panel consisting of 35 contact fields, each of which is a square of side length 25 cm bent to lie on a cylinder of radius about 100 cm; the panel is 175 cm high, and 125 cm wide. Accordingly the contestant faces an arc which subtends about 72°,which is only about 40% of normal frontal and peripheral vision of a human being. In fact the contestant can use the apparatus without ever turning his head. Also the 7 vertical striking surfaces or "contact fields" in each of the 5 columns, though resilient, are neither movable nor elastic. However, they are signaled by a programmable or pseudo-random sequencer which switches on optical signal devices that remain on until the designated contact field is struck, at which epoch the reaction time is measured and the light turned off.

Hall shows an electronic reflex game wherein one of a plurality of switches is manipulated by a player to deactuate one of a plurality of light bulbs, which are randomly actuated.

Yang shows an electronic apparatus for improving skills in reflex, speed and accuracy in which multiple targets spread around the player are randomly selected by an electronic device. The target designations are indicated by both audio alarms and visual devices such as light emitting diodes. Target selection actuates a timer which is halted when the target is hit by the player. Elapsed time is displayed electronically. The targets are arranged para-peripherally at varying distances and heights but are not disposed upon a cylindrical surface. The hitting of a target is not necessarily done by a strong physical blow to a resilient target but by the player touching or hitting or kicking a target ring attached to a spring which absorbs the impact energy and then restores the target ring support arm to its original position; this support arm determines the open and closed conditions of the reset switch which is opened when the target ring is moved. This device trains for reflex, speed, and accuracy but not primarily for strength of punching, kicking or other blows involving application of the player's physical force upon the targets. Thus this device is somewhat suitable for oriental martial arts training but is more adapted to training for sports like tennis or fencing; other sports mentioned are basketball, volleyball, baseball, football, soccer, badminton, cricket, paddleball, etc.

Redington shows a psychophysiological reflex training arc simulator which measures more of the reflex performance than mere length of reaction time; it includes complex stimuli that must be discriminated among. Both audio and visual stimuli are used. The user faces the apparatus and punches a pad in specified modes of striking behavior in accordance with audio commands. The emphasis is on reaction stimuli having at least two forms and upon energizing such stimuli in accordance with a preselected degree of difficulty and upon evaluation of three different phases of reflex time. The training simulator includes an electronic controller which may be a suitably programmed single-chip microcomputer or personal computer.

Horvath et al shows a primarily mechanical boxing training device which uses movable and elastically tethered reaction bodies such as elastic punching balls; the improvement includes the use of a plurality of reaction bodies in staggered striking heights and movement planes and means for measurement of the energy of the punching force. The trainee faces the flat frame containing the targets and makes spontaneous decisions of his own regarding which target to hit and when to hit it.

Rastelli shows a martial arts training apparatus consisting of a flat screen divided into four zones, each of which displays at random the word "block", and a fifth zone, displaying at random the word "attack". The trainee stands facing the screen and responds to each instruction appropriately but does not strike the device and monitors his own efficiency of response subjectively.

Hartman et al shows an electronic martial arts training device including a resilient flat pictorial representation of a human figure on a pliable substrate of sufficient thickness to absorb a full impact martial arts blow without injury to the deliverer thereof. A plurality of target lights randomly designate vital points of the pictured combatant. Associated with each such point is a vibration transducer such as a miniature loud speaker which generate signals in response to a blow in the vicinity of the vital point. A control circuit is used to selectively illuminate the target lights and to score the student's proficiency of response. The student faces the flat picture and need never turn his field of vision in order to respond efficiently.

None of the references show a para-peripheral cylindrical training device of multi-sided modular construction disposed upon hinged panels and including vertically arrayed multiplets of selectively designatable targets which are capable of absorbing the full impact of a martial arts blow without injury to the human deliverer thereof, who may be required to turn both his head and his body in order to respond to para-peripheral stimuli.

To the contrary, the only reference which is para-peripheral contains no suggestion of cylindrically symmetric arrangement nor of utilization of targets capable of absorption of full impact martial arts blows without injury to the deliverer thereof, while the only reference which is arcuate subtends less than about a two-fifths of the normal human peripheral vision and contains no suggestion of extension to encompass para-peripheral training. Likewise the only references disclosing targets capable of absorption of full impact martial arts blows without injury to the deliverer thereof are all disposed upon flat structures facing the trainee and contain no suggestion of extension of the size of the structure and bending it around the trainee so as to encompass para-peripheral training.

OBJECTS AND ADVANTAGES

Accordingly several objects and advantages of the present invention are:

- to provide a para-peripheral sports training center in which the trainee must respond to para-peripheral stimuli;
- to provide a para-peripheral sports training center in which the trainee may impact preselected designated target devices which are resilient and capable of absorbing a full impact martial arts blow without injury to the deliver thereof;
- to provide a para-peripheral sports training center surrounding or partially surrounding a multi-sided paraperipheral volume and comprised of a number of adjacently hinged panels, which may also be opened out into a planar configuration or even inverted so that the volume is placed exteriorly to the target surfaces of the panels;
- to provide a para-peripheral sports training center including an electronic control and monitoring system for randomly designating targets and recording the duration of the trainee's reaction time before the target is struck and for scoring the trainee's cumulative performance during a session.

DRAWING FIGURES

FIGS. 4A–4D present the detailed structure of a single panel in front, side, back, and top projections.

Figure 1:
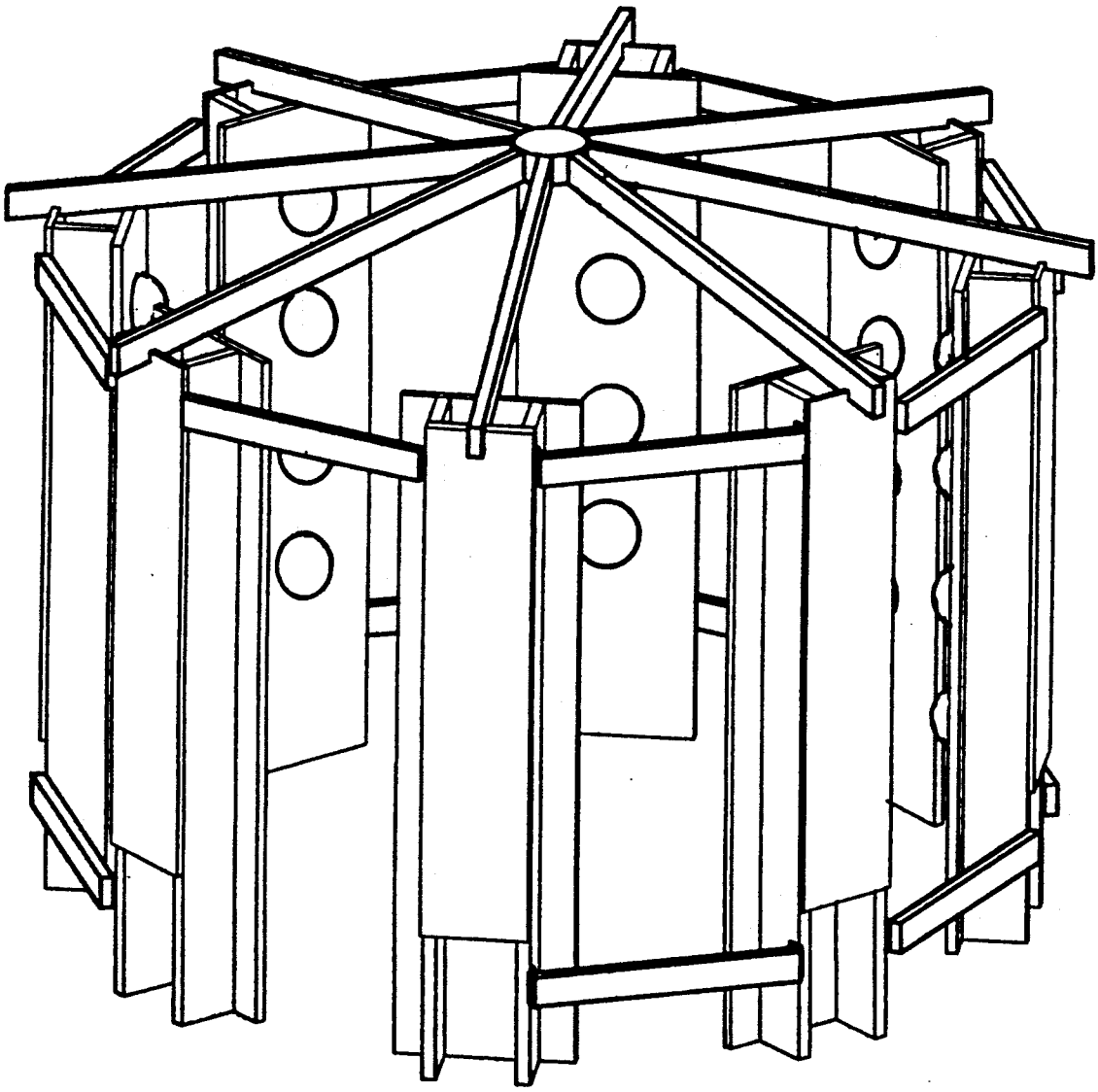
FIG. 1 is a perspective view of the octagon structure embodiment.
Figure 2:
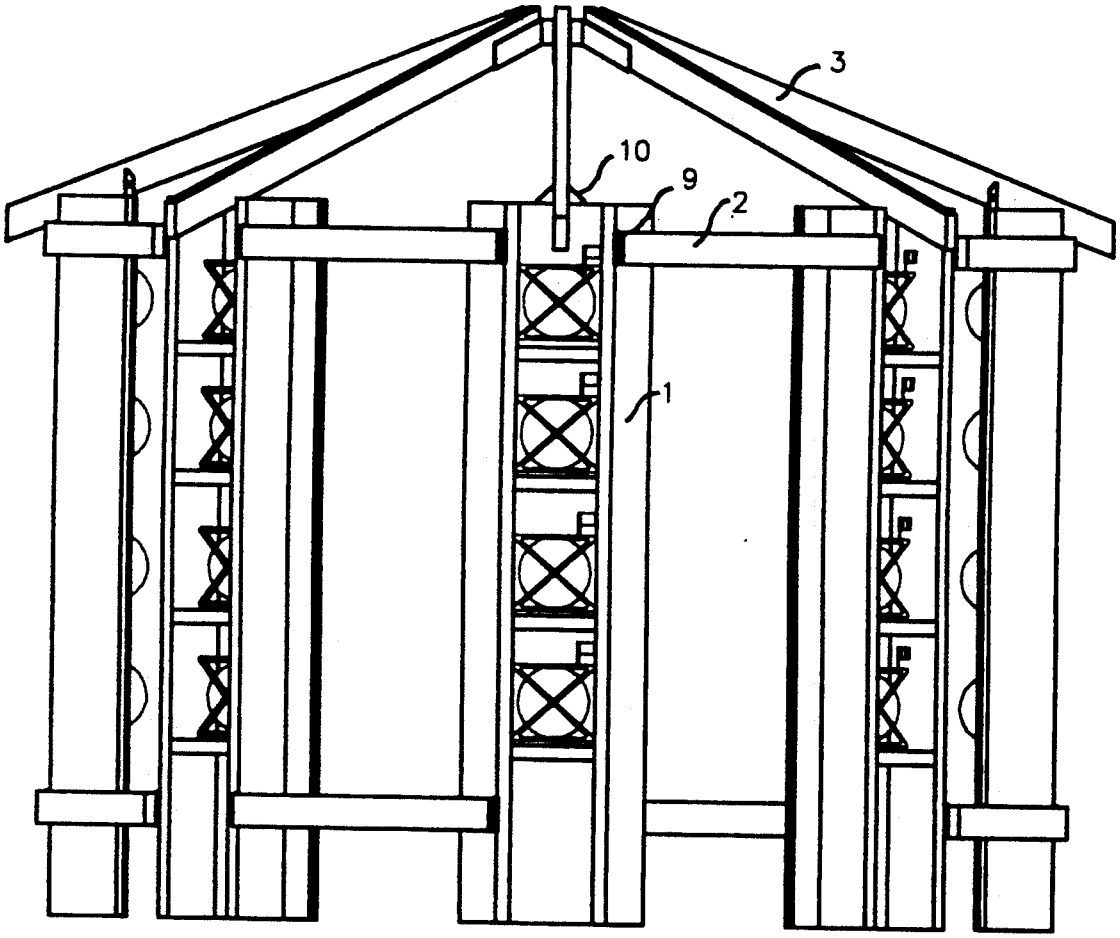
FIG. 2 is a planar side view of the octagon structure.
Figure 3:
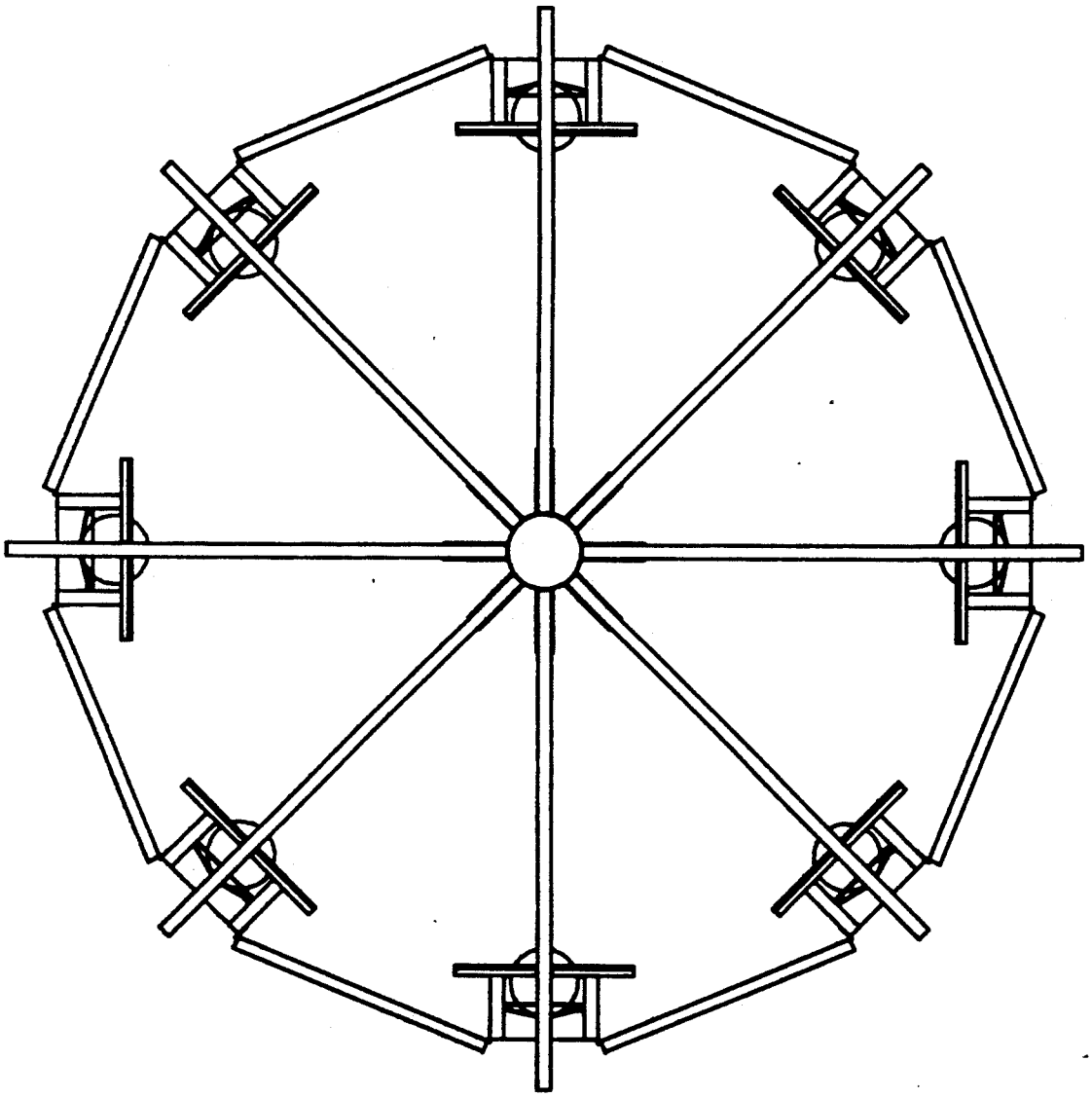
FIG. 3 is a planar top view of the octagon structure.
Figure 4D:
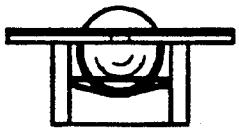
Figure 4A:
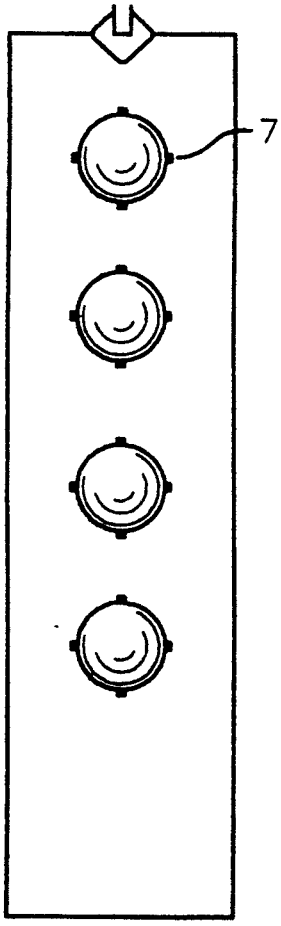
Figure 4B:
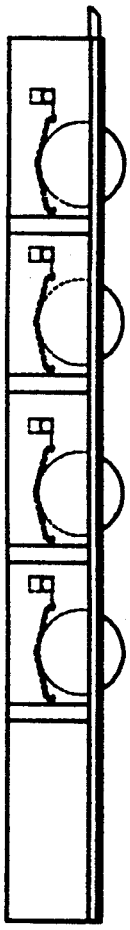
Figure 4C:
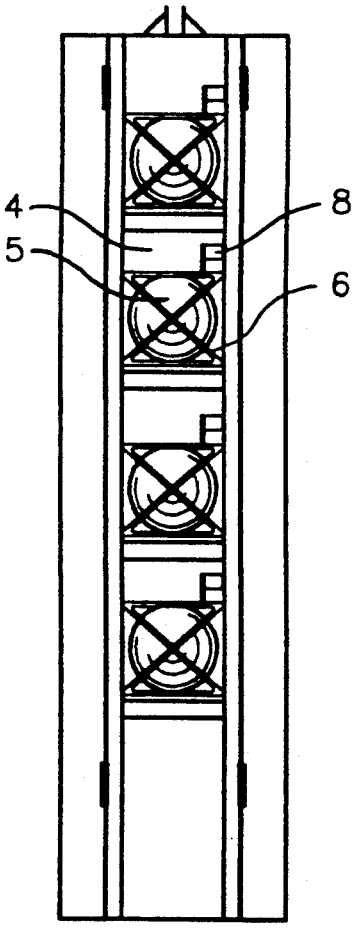
Figure 5:
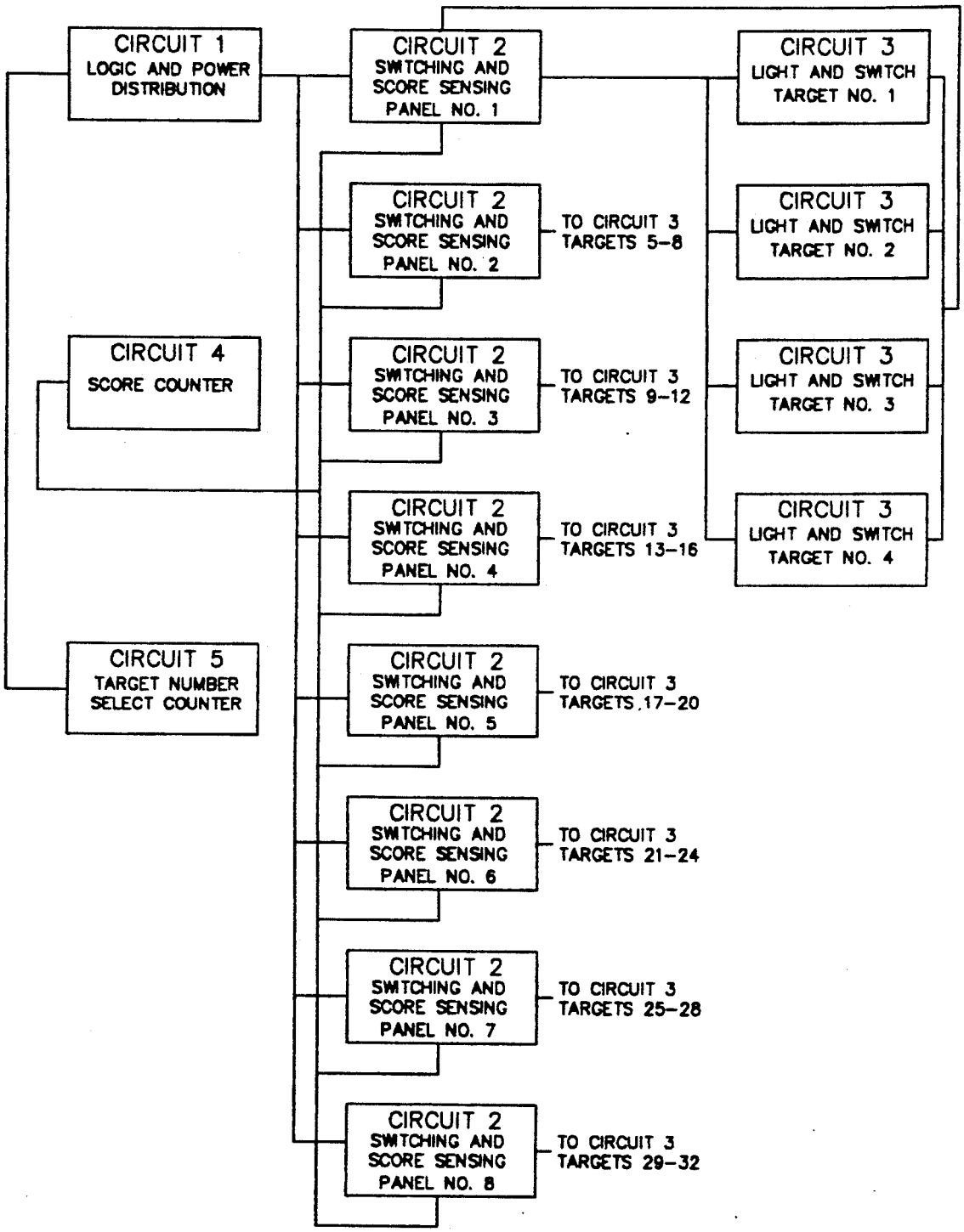

FIG. 5 is a functional block diagram of the electrical and electronic circuitry which comprises the timing and selection means whereby the switching and scoring functions are automated.

DESCRIPTION —FIGS. 1 TO 5

The Octagon is a room made up of eight sides or panels 1. These panels are held together by horizontal beams 2 and a roof structure 3. The inside diameter of the structure is about eight feet. This is enough room for the average adult to make some basic transition maneuvers to get from one target to another. Each of the panels 1 contains four target sockets 4. The target sockets 4 each contain a ball 5. Each of the balls 5 is suspended in its socket 4 by an elastic cord 6. The portion of the balls 5 which stick out of the panels and face the inside of the structure are the striking surfaces. The targets in each panel 1 are located at the head, chest, pelvis, and knee level for a typical six-foot tall person. Each ball 5 is surrounded by four dual Light Emitting Diodes 7 which illuminate the target when that target is selected. Each target also has a switch 8 positioned against the elastic cord which is set to open its contact when a ball 5 is struck.

The structure is designed such that the panels 1 and support beams 2 are hinged with respect to each other using door hinges 9. In an area where space is a concern, the panels can be moved up against a wall in a flat arrangement so eight separate workout stations are created. This is implemented by lifting off the roof by removing eight bolts from the eight hurricane tie attach points 10 and removing two door hinge pins on the same side of one of the panels. This allows the structure to be separated at one point on the circle. The structure can then be pushed around in a variety of configurations. The circular arrangement can even be turned inside out so that the eight targets face away from the center of the circle. Up to eight persons can approach them by standing on the outside of the structure instead of the inside.

FIGS. 1 through 4 do not show details of the electrical installation except for the target lights 7 and switches 8.

The electrical system is made up of five sub-circuits which are described below and depicted in the electrical block diagram of FIG. 5.

Sub-circuit 1: This is the logic circuit which sets the timing and the number of targets to be selected at time. These variables are selected by the user manually selecting switch position. A clock pulse is generated continuously for the duration of the session. The presently preferred embodiment is capable of switching up to four targets at a time for up to eight seconds duration before the next set of lights come on. There is a pause between these "high"times when the targets are illuminated. This pause can be varied but, for the presently preferred embodiment, one second is used.

Sub-circuit 2: This is a switching and score sensing circuit. It interfaces with the logic circuit (sub-circuit 1), the light/switch circuit (sub-circuit 3), and the score counting circuit (sub-circuit 4).

Sub-circuit 3: This is the light & switch circuit. Each of 32 targets contains one of these circuits. It is wired so that, when a target is struck while it is illuminated, the switch contacts are opened, the light goes out and remains out even when the switch contact is closed again until the target is selected again.

Sub-circuit 4: This is the counter which keeps track of the score, or number of targets which are struck while they are lit. It is a numerical display.

Sub-circuit 5: This is the counter which keeps track of the total number of targets selected. It is a numerical display.

OPERATION —FIGS. 1 TO 5

The user stands inside an octagon structure which contains thirty-two targets arrayed around him in a circular pattern. There are eight panels which make up the octagon-shaped structure. These panels are made to represent the body with the four targets arranged at four levels representing the head, chest, pelvis and knee are of a simulated opponent.

When the session starts, targets are randomly selected electronically and lit up for a preselected time time interval (which may be from one to eight seconds). The practitioner must strike a designated target before the light goes out in order to get a score. There are several ways in which this can be done. Typically, hands, feet, knees, elbows and head are used to punch, kick, or deliver a blow to the target. There is sufficient space inside the structure for maneuvering between the targets with stepping, jumping, shuffling, twisting or spinning moves.

When the target is struck while it is illuminated, the light goes out and a score is tallied by the counter circuit. After each time interval, a pause occurs (e.g. one second) and another randomly selected target (or targets) is illuminated. This goes on until the session is over.

SUMMARY, RAMIFICATIONS AND SCOPE

Accordingly, the reader will see that the present invention provides a para-peripheral sports training center in which the trainee must respond to para-peripheral stimuli. Furthermore the training center has the additional advantages in that

- it provides a training center in which the trainee may impact preselected designated target devices which are resilient and capable of absorbing a full impact martial arts blow without injury to the deliver thereof;
- it provides a training center surrounding or partially surrounding a multi-sided para-peripheral volume and comprised of a number of adjacently hinged panels, which may also be opened out into a planar configuration or even inverted so that the volume is placed exteriorly to the target surfaces of the panels;
- it provides a training center including an electronic control and monitoring system for randomly designating targets and recording the duration of the trainee's reaction time before the target is struck and for scoring the trainee's cumulative performance during a session;
- it provides a training center which may be used for physical therapy rather than sports, competition, or amusement;
- it provides a training center which may be readily constructed in a modular fashion from inexpensively available parts such as panels, hinges, basketballs, etc.

Although the description above contains many specificities, these should not be construed as limiting the scope of the invention but as merely providing illustrations of some of the presently preferred embodiments of this invention.

Many variations and modifications will be readily apparent to those skilled in the art in the light of the above teachings. For example, although the panel structure is currently wood covered with rubber for padding, one may use other materials such as fiber glass or plastic with upholstered material (vinyl or leather) over foam padding. The current panel design is rectangular with a flat profile facing the practitioner. An alternative is to use a rounded profile, in that elimination of sharp corners reduces the chances of accidental injury. Also, using rounded target housings would allow a more accurate representation of the human anatomy of the simulated opponent. Targets can be installed in the sides or back representing kidney, liver and the back of head as vital locations. The four target positions in each panel are currently fixed. An alternative would be to make each target (including switch and light) into a modular unit. These modules can be stacked with spacers in a variety of configurations to alter the relative spacing and overall height of each vertical display.

An outdoor version can be made with posts set in the ground. The targets can be made to adjust to various heights by sliding up and down the support posts and being pinned into place.

The diameter of the enclosure can be adjusted by adjusting the length of the beams which join two adjacent panels together. Another way of accomplishing this is to provide tracks in the floor and/or to substitute floor fasteners in lieu of the roof and support beams for a quick adjustment of the enclosure size.

For medical rehabilitation applications adjustable heights and additional instrumentation to assess strength would be required. Additional targets in the ceiling would be required for assessing lifting ability.

Variations in the control logic are also possible. The method of selecting the targets for striking is done in two basic ways. In the presently preferred model, targets are selected at random (one to four at a time) in a selected time interval up to eight seconds. This is accomplished by a random generator circuit. Another method is to replace the random generator with a microprocessor which can be programmed to select the targets in a predetermined manner with adjustable timing parameters offering a greater variety of timing and target display options.

Instrumentation can be added for measuring applied force, which would be particularly desirable in the medical category already mentioned.

Finally, lights are not the only stimuli that can be used to initiate a reaction. Tactile sensation (using an air jet) or sound originating at the target source can be implemented to broaden the practitioner's awareness using other senses.

Thus the scope of the invention should be determined by the appended claims and their legal equivalents, rather than by the examples given.

I claim:

1. A para-peripheral sports training, competition and amusement center in which a contestant may stand and move about, comprising a multi-sided para-peripheral volume circumscribed by a boundary surface comprised of a plurality of adjacently hinged panels which form an enclosed cylindrical configuration or which may also be opened into a planar configuration or inverted so that said volume is disposed exteriorly to said surface, wherein a plurality of resilient target devices, each of which is capable of absorbing a full impact martial arts blow without injury to the deliverer thereof, is disposed para-peripherally on a plurality of said panels, and wherein a plurality of sensory stimulus means is disposed on said panels such that at least one such stimulus means is adjacent to and uniquely associated with each of said target devices, whereby said contestant is alerted and directed toward a particular one of said target devices by activation of a particular one of said stimulus means, and wherein programmable timing and selection means are connected to each of said stimulus means to direct activation of said stimulus means in a preselected manner for preselected durations of time at preselected epochs following in a preselected sequence and after preselected inactive durations of time, and wherein strike-detection means, capable of detection, during said active durations of time, of punches and kicks and blows, are connected to each of said target devices and to an automatic cumulative scoring means, wherein said scoring means provides said contestant with an objective record of the attained levels of reaction times and number of hits at the completion of each exercise session.

2. The para-peripheral center of claim 1 wherein said target devices are flexible balls.

3. The para-peripheral center of claim 2 wherein said balls are inflatable elastic spheres.

4. The para-peripheral center of claim 1 wherein said stimulus means comprise visual stimuli.

5. The para-peripheral center of claim 1 wherein said stimulus means comprise auditory stimuli.

6. The para-peripheral center of claim 1 wherein said stimulus means comprise tactile stimuli.

7. The para-peripheral center of claim 1 wherein said strike-detection means comprise means for detection also of the force of said punches and kicks and blows.

8. The para-peripheral center of claim 1 wherein said selection means includes a random number generation means for selecting said sequencing of said stimuli.

9. The para-peripheral center of claim 1 wherein said selection means includes a pseudo-random number generation means for selecting said sequencing of said stimuli.

10. The para-peripheral center of claim 1 wherein said timing means includes means for preselecting said duration of said stimuli and for preselecting said duration of inactive times between said stimuli.

11. The para-peripheral center of claim 1 wherein said timing means includes means for preselecting the mean duration of said stimuli and for preselecting the mean duration of inactive times between said stimuli, together with random-number generating means for varying said durations from said means by deviations of a preselected probability-distributional character.

12. The para-peripheral center of claim 1 wherein said timing means includes means for preselecting the mean duration of said stimuli and for preselecting the mean duration of inactive times between said stimuli, together with pseudo-random-number generating means for varying said durations from said means by deviations of a preselected probability-distributional character.

13. The para-peripheral center of claim 1 wherein said selection and timing means is comprised of electrical and electronic circuitry.

14. The para-peripheral center of claim 1 wherein said scoring means is comprised of electrical and electronic circuitry.

15. The para-peripheral center of claim 1 wherein said plurality of panels consists of an octet and said boundary surface is an octagonal cylinder.

16. The para-peripheral center of claim 1 wherein said plurality of target devices consists of a quartet of target devices disposed upon each of said panels.

17. The para-peripheral center of claim 16 wherein said quartet of target devices consists of one device each placed at the average height of the head, chest, pelvis and knee of a human of preselected mean stature.

18. The para-peripheral center of claim 2 herein said balls are so suspended as to be able to move backward when struck and then return to their original position.

19. The para-peripheral center of claim 2 wherein said balls are suspended by elastic cords.

* * * * *